US009856766B2

(12) United States Patent
Kase et al.

(10) Patent No.: US 9,856,766 B2
(45) Date of Patent: Jan. 2, 2018

(54) EXHAUST MUFFLER AND SOUND DEADENING ELEMENT

(71) Applicant: HONDA MOTOR CO., LTD., Tokyo (JP)

(72) Inventors: Hiroaki Kase, Wako (JP); Satoshi Ishihara, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/263,106

(22) Filed: Sep. 12, 2016

(65) Prior Publication Data

US 2017/0089239 A1 Mar. 30, 2017

(30) Foreign Application Priority Data

Sep. 29, 2015 (JP) ..... 2015-191439

(51) Int. Cl.
*F01N 1/10* (2006.01)
*F01N 1/04* (2006.01)
(Continued)

(52) U.S. Cl.
CPC ..... *F01N 1/10* (2013.01); *F01N 1/006* (2013.01); *F01N 1/026* (2013.01); *F01N 1/04* (2013.01); *F01N 1/083* (2013.01); *F01N 13/007* (2013.01); *F01N 13/185* (2013.01); *F01N 13/1866* (2013.01); *G10K 11/161* (2013.01); *F01N 2310/14* (2013.01); *F01N 2450/06* (2013.01); *F01N 2470/08* (2013.01); *F01N 2470/24* (2013.01); *F01N 2490/04* (2013.01)

(58) Field of Classification Search
CPC .... F01N 2310/14; F01N 2450/06; F01N 1/10; F01N 1/006; F01N 1/026; F01N 1/04
USPC ..... 181/252, 256
See application file for complete search history.

(56) References Cited

U.S. PATENT DOCUMENTS 5,892,186 A * 4/1999 Flugger ..... F01N 1/04 181/252
5,992,560 A * 11/1999 Matsuoka ..... F01N 1/24 181/252

(Continued)

FOREIGN PATENT DOCUMENTS

| | | |
|---|---|---|
| EP | 1 048 827 A1 | 11/2000 |
| EP | 2 016 260 A2 | 1/2009 |
| JP | 11-324641 | 11/1999 |

*Primary Examiner* — Jeremy Luks
(74) *Attorney, Agent, or Firm* — Rankin, Hill & Clark LLP

(57) ABSTRACT

An exhaust muffler in which the anti-scattering property of a sound deadening element is high and for which shaping is not required and a sound deadening element for use with the exhaust muffler. An exhaust muffler includes an expansion chamber into which exhaust gas of an engine is introduced, and a sound deadening element in which the expansion chamber is inserted. The sound deadening element is configured from a knitted article formed by knitting continuous fibers of glass fiber. The exhaust muffler further includes an inner pipe inserted in a spaced relationship from an inner circumferential wall of the expansion chamber in the expansion chamber and configured to introduce the exhaust gas therethrough. The sound deadening element is disposed between an outer circumferential wall of the inner pipe and the inner circumferential wall of the expansion chamber.

11 Claims, 4 Drawing Sheets

(51) Int. Cl.

| | |
|---|---|
| ***F01N 1/08*** | (2006.01) |
| ***G10K 11/16*** | (2006.01) |
| ***F01N 13/00*** | (2010.01) |
| ***F01N 13/18*** | (2010.01) |
| ***F01N 1/00*** | (2006.01) |
| ***F01N 1/02*** | (2006.01) |

(56) References Cited

U.S. PATENT DOCUMENTS 6,520,285 B2 * 2/2003 Tobias ..... F01N 1/24 181/227
8,083,025 B2 * 12/2011 Murakami ..... F01N 1/24 181/249
8,256,569 B1 * 9/2012 Huff ..... F01N 1/10 181/252
8,505,339 B2 * 8/2013 Malloy ..... F01N 13/148 66/170
2002/0088667 A1 * 7/2002 Naito ..... F01N 1/24 181/252
2003/0019688 A1 * 1/2003 Takewaka ..... F01N 1/24 181/252
2004/0003630 A1 * 1/2004 Akers ..... F16L 59/029 66/197
2004/0089500 A1 * 5/2004 Lewis ..... F01N 1/10 181/249
2007/0261914 A1 * 11/2007 Wahlgren ..... F01N 1/24 181/252
2008/0196970 A1 * 8/2008 Honma ..... F01N 1/006 181/256
2012/0031698 A1 * 2/2012 Inoue ..... F01N 1/10 181/252
2012/0261210 A1 * 10/2012 Kondou ..... F01N 1/023 181/228
2013/0112498 A1 * 5/2013 Maejima ..... F01N 13/08 181/228
2013/0180798 A1 * 7/2013 Matsushima ..... F01N 1/082 181/228

* cited by examiner

FIG. 2
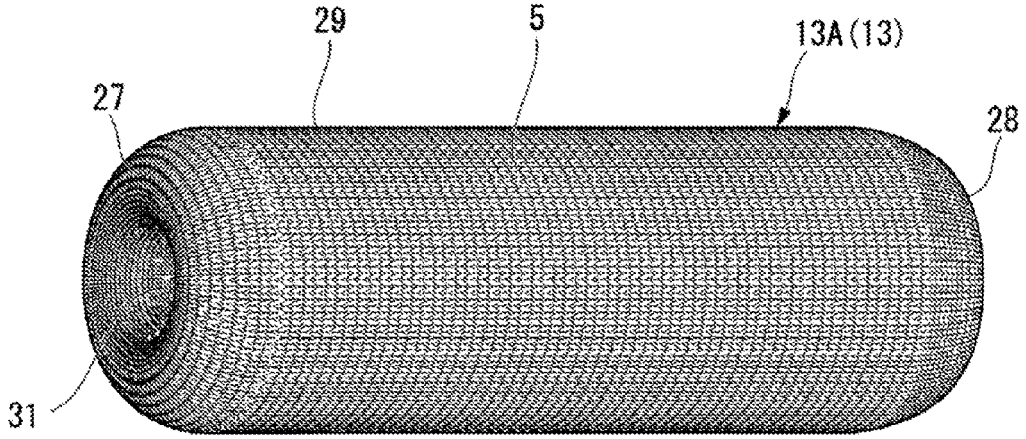
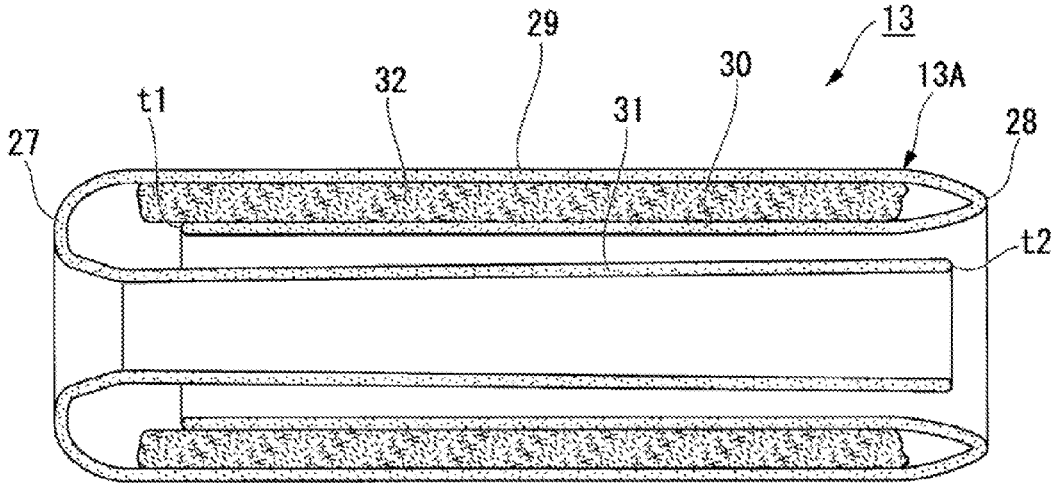
FIG. 3

EXHAUST MUFFLER AND SOUND DEADENING ELEMENT

BACKGROUND OF THE INVENTION

Field of the Invention

The present invention relates to an exhaust muffler and a sound deadening element.

Description of Related Art

In the past, in an exhaust muffler of a vehicle, glass wool is inserted for thermal insulation and sound deadening.

In Japanese Patent Laid-Open No. 1999-324641, a technology is disclosed that, in order to prevent scattering of glass wool when glass wool is inserted as a sound deadening element into an exhaust muffler, a bundled element configured by bundling a great number of continuous fibers is overlaid and fixedly adhered in a planar shape to the glass wool. Also it is disclosed that such a planar bundled element as just described is folded back and disposed in an exhaust muffler.

A sound deadening element in an exhaust muffler is formed in a glass mat by a fabrication method such as, for example, needle punch using short glass fibers in order to apply the sound deadening element to a portion upon which exhaust gas having a high flow velocity and a high temperature directly hits. Therefore, intertwined fibers are likely to be scattered by the back pressure of the exhaust gas. On the other hand, a technique is available that a glass mat is impregnated with a binder having, for example, colloidal silica as a principal component and shaped to solidify the mat having flexibility to improve the anti-scattering property. In this case, the shaped sound deadening element cannot be assembled to a cylindrical portion, and therefore, it becomes necessary to add a slit or the like, and the glass wool is scattered from the slit. Accordingly, a sound deadening element that has a high anti-scattering property and does not require shaping is demanded.

On the other hand, in the exhaust muffler and the sound deadening element disclosed in Japanese Patent Laid-Open No. 1999-324641, a great number of fiber ends exist, which similarly degrades the anti-scattering property. Further, such a process for preventing exposition of fiber ends is demanded, which increases the number of processing steps.

SUMMARY OF THE INVENTION

Therefore, the present invention is directed toward providing an exhaust muffler in which the anti-scattering property of a sound deadening element is high and for which shaping is not required and a sound deadening element for use with the exhaust muffler.

In accordance with the present invention, there is provided an exhaust muffler including an exhaust gas introduction chamber into which exhaust gas of an engine is introduced, and a sound deadening element inserted in the exhaust gas introduction chamber, wherein the sound deadening element is configured from a knitted article formed by knitting continuous fibers of glass fiber.

Exposure of the fiber ends in the sound deadening element can be reduced as far as possible and the anti-scattering property of the sound deadening element can be improved. Further, since the sound deadening element is configured from a knitted article of continuous fibers, the necessity for shaping when short fibers are used is eliminated, and reduction of the number of fabrication steps can be achieved.

In further accordance with the present invention, the exhaust muffler further includes an inner pipe inserted in a spaced relationship from an inner circumferential wall of the exhaust gas introduction chamber in the exhaust gas introduction chamber and configured to introduce the exhaust gas therethrough, wherein the sound deadening element is disposed between an outer circumferential wall of the inner pipe and the inner circumferential wall of the exhaust gas introduction chamber.

Accordingly, the sound deadening element can be retained on the outer circumferential wall of the inner pipe and the inner circumferential wall of the exhaust gas introduction chamber and the shape of the sound deadening element can be maintained easily.

In further accordance with the present invention, the sound deadening element is formed in a cylindrical shape continuous in a circumferential direction of the inner pipe.

Accordingly, it is easy to dispose the sound deadening element uniformly in the circumferential direction of the inner pipe and the sound deadening element can be disposed with a high efficiency in the exhaust introduction chamber thereby to achieve reduction of the weight. Further, since the sound deadening element is configured from a knitted article, the cylindrical sound deadening element continuous in the circumferential direction can be formed easily.

In further accordance with the present invention, the sound deadening element includes a folded portion of the knitted article folded back in an axial direction of the inner pipe, and the folded portion is disposed on an exhaust upstream side of the exhaust gas introduction chamber.

Accordingly, the sound deadening element of a plurality of layers can be disposed on the outer circumference of the inner pipe by the folding of the knitted article. Further, by disposing the folded portion of the knitted article on the exhaust upstream side, the anti-scattering property on the exhaust upstream side on which the exhaust pressure is high can be enhanced further in comparison with an alternative case in which the extremity of the knitted article is disposed on the exhaust upstream side.

In further accordance with the present invention, the sound deadening element has an extremity of the knitted article disposed on an inner side of the folded portion on the exhaust upstream side of the exhaust gas introduction chamber. Accordingly, also where the extremity of the knitted article is disposed on the exhaust upstream side by the folding of the knitted article, the extremity can be disposed on the inner side of the folded portion to enhance the anti-scattering property. Further, the multi-layer sound deadening element can be disposed on the outer circumference of the inner pipe by the folding of the knitted article.

In further accordance with the present invention, the knitted article is formed by a rib knit article which is elastic in the circumferential direction of the inner pipe and is folded back in the axial direction, and a cotton pad is disposed on an inner side of the folded location of the knitted article.

Accordingly, the sound deadening element can be disposed in a closely fit relationship on the outer circumference of the inner pipe through the rib-knit knitted article, which is elastic in the circumferential direction of the inner pipe. Further, the sound deadening property can be enhanced while the anti-scattering property is enhanced by disposing the cotton pad on the inner side of the folded knitted article.

In further accordance with the present invention, a through-hole is formed in the outer circumferential wall of the inner pipe, and the exhaust gas introduced by the inner pipe passes through the through-hole and is expanded in the exhaust gas introduction chamber, the sound deadening element being retained on the outer circumference of the inner pipe.

Accordingly, in the structure that exhaust gas having a high exhaust pressure passes through the through-hole of the inner pipe and expands in the exhaust gas introduction chamber, the sound deadening element is retained on the outer circumference of the inner pipe. Therefore, the necessity for provision of a retaining member for exclusive use is eliminated thereby to achieve simplification and reduction of the weight. Further, the energy upon expansion of exhaust gas can be attenuated effectively.

In further accordance with the present invention, there is provided a sound deadening element for being inserted in an exhaust gas introduction chamber of an exhaust muffler, wherein the sound deadening element is formed from a knitted article formed by knitting continuous fibers of glass fiber.

BRIEF DESCRIPTION OF THE DRAWINGS

These and further features of the invention will be apparent with reference to the following description and drawings, wherein:

FIG. 2 is a perspective view of a sound deadening element of the exhaust muffler.

FIG. 3 is a sectional view taken along an axial direction of the sound deadening element.

DETAILED DESCRIPTION OF THE INVENTION

Figure 1:
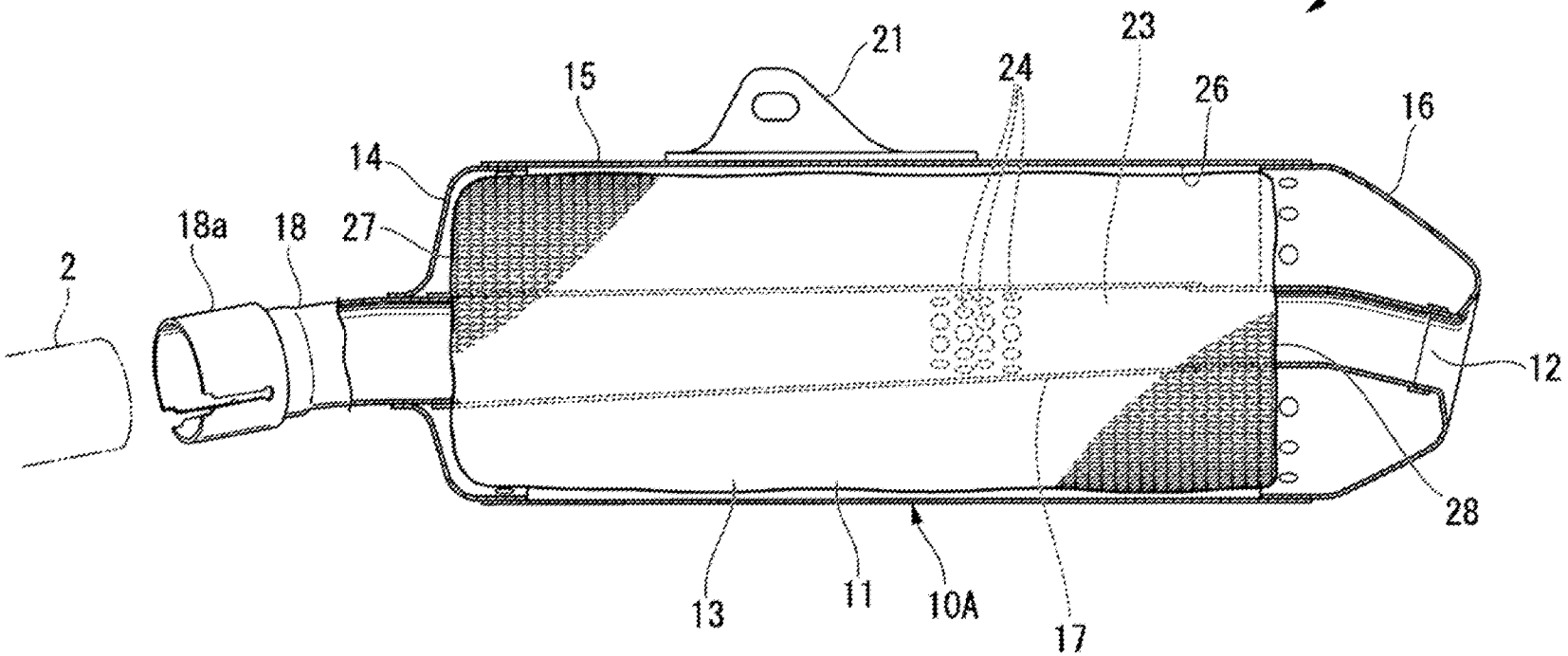
FIG. 1 is a sectional view taken along an axial direction of an exhaust muffler in an embodiment of the present invention.

An exhaust muffler 10 depicted in FIG. 1 is used for a vehicle such as a motorcycle, and exhaust gas of an engine (internal combustion engine) of the vehicle is introduced into the exhaust muffler 10 through an exhaust pipe 2. In the exhaust muffler 10, the cross section increases with respect to the exhaust pipe 2 to allow exhaust gas introduced thereto from the exhaust pipe 2 to expand and attenuate exhaust energy of the exhaust gas to deaden the sound of the exhaust gas. The exhaust muffler 10 includes a muffler main body 10A which forms an expansion chamber 11 for introducing and expanding exhaust gas and a sound deadening element 13 disposed in the expansion chamber 11. The muffler main body 10A has a cylindrical appearance extending linearly. In the following description, the longitudinal direction of the cylinder shape of the muffler main body 10A is referred to as forward and rearward direction, and the side of the muffler main body 10A with which the exhaust pipe 2 is coupled is referred to as front side and the side of the muffler main body 10A on which an exhaust port 12 is formed and which is the opposite side to the exhaust pipe 2 is referred to as rear side.

The muffler main body 10A includes a front cap 14, a cylindrical body 15, an end cap 16, an inner pipe 17, and a front pipe 18. The expansion chamber 11 is formed from the front cap 14, the cylindrical body 15, and the end cap 16 and extends in the forward and rearward direction. The front cap 14 retains the inner pipe 17 such that a front end portion of the inner pipe 17 extends therethrough. The end cap 16 retains the inner pipe 17 such that a rear end portion of the inner pipe 17 extends therethrough. The inner pipe 17 is formed in a cylindrical shape parallel to the cylindrical body 15 extending in the forward and rearward direction. The cylindrical body 15 and hence the exhaust muffler 10 have a cross sectional shape to which one of a circular shape including an elliptical shape and various polygons is applied. A bracket 21 for attachment to the vehicle body is fixed to an upper portion of the cylindrical body 15.

The front pipe 18 connects integrally to the front of the inner pipe 17. A front end portion of the front pipe 18 serves as a pipe sleeve 18*a* for connecting to the exhaust pipe 2. A rear end opening of the inner pipe 17 is positioned in a through-hole of the end cap 16 and forms the exhaust port 12 at a rear end of the exhaust muffler 10.

The inner pipe 17 is disposed in a spaced relationship from an inner circumferential wall 26 on the inner circumference of the cylindrical body 15 in the inside of the expansion chamber 11. It is to be noted that, while the cylindrical body 15 and the inner circumferential wall 26 in the present embodiment are integrated with each other, they may otherwise be formed as separate members that cooperate to form a double cylinder pipe. A plurality of through-holes 24 in the form of punching holes are formed in an outer circumferential wall 23 of the inner pipe 17 which extends linearly in the forward and rearward direction.

The sound deadening element 13 is disposed so as to fill up a gap between the inner circumferential wall 26 on the inner side of the cylindrical body 15 and the outer circumferential wall 23 of the inner pipe 17.

Referring to FIGS. 2 and 3, the sound deadening element 13 is formed from a knitted article 13A formed by knitting long-fiber yarns 5 into a cylindrical shape using continuous fibers of glass fiber. The sound deadening element 13 is mounted and retained on the outer circumference of the inner pipe 17 in such a manner as to enclose the outer circumference of the inner pipe 17.

The knitted article 13A is formed by knitting long-fiber yarns 5 formed from glass fiber so as to have elasticity in a circumferential direction of the inner pipe 17, for example, by rib knitting. The knitted article 13A and hence the sound deadening element 13 are formed in cylindrical shape continuous in the circumferential direction of the inner pipe 17.

The sound deadening element 13 folds back the knitted article 13A by a plural number of times (in the present embodiment, twice) in the axial direction of the inner pipe 17. Consequently, the knitted article 13A is folded to triple on the outer circumference of the inner pipe 17. The sound deadening element 13 has a first folded portion 27 and a second folded portion 28. The first folded portion 27 is disposed on the front side (exhaust upstream side) of the expansion chamber 11 while the second folded portion 28 is disposed on the rear side (exhaust downstream side) of the expansion chamber 11.

The knitted article 13A is folded such that it has an outer cylindrical portion 29, an intermediate cylindrical portion 30, and an inner cylindrical portion 31.

The outer cylindrical portion 29 extends rearwardly from the first folded portion 27, and the intermediate cylindrical portion 30 extends forwardly from the second folded portion 28 at the rear end of the outer cylindrical portion 29. The inner cylindrical portion 31 extends rearwardly from the first folded portion 27. The intermediate cylindrical portion 30 is sandwiched between the inner cylindrical portion 31 and the outer cylindrical portion 29. A cotton pad 32 formed, for example, from a glass mat is sandwiched between the intermediate cylindrical portion 30 and the outer cylindrical portion 29. Consequently, the sound deadening element 13 is formed in four layers.

From between the opposite extremities of the cylindrical knitted article 13A, a first extremity t1 directed forwardly is disposed on the inner side of the first folded portion 27. Consequently, exposure of the extremity of the knitted article 13A is suppressed on the exhaust upstream side on which the exhaust pressure is comparatively high in the expansion chamber 11. Although fiber ends are liable to be exposed to the extremity of the knitted article 13A, by disposing the extremity of the fiber ends on the inner side of the first folded portion 27, scattering of glass fibers by the exhaust pressure is suppressed. Further, the front and rear extremities of the cotton pad 32 are disposed on the inner side of the first folded portion 27 and the second folded portion 28, respectively. Consequently, scattering of glass fibers by the exhaust pressure also from the cotton pad 32 is suppressed.

It is to be noted that a second extremity t2 directed rearwardly from between the two extremities of the cylindrical knitted article 13A is disposed in a neighboring relationship on the inner circumference side of the second folded portion 28. This extremity is positioned on the exhaust downstream side on which the exhaust pressure is comparatively low in the expansion chamber 11 and is directed to the rear which is the exhaust downstream side, the influence of the extremity exposed to the outer side of the sound deadening element 13 is low.

When the knitted article 13A is to be knitted by rib knitting, starting stitches are created first, and then a face stitch and a back stitch are repetitively knitted on every other wale for the first course, and also for the second course, a face stitch and a back stitch are repetitively knitted in every other wale such that the face stitches and the back stitches are included in the respective same wales. This process is described also for the succeeding courses to form the cylindrical knitted article 13A.

Figure 4:
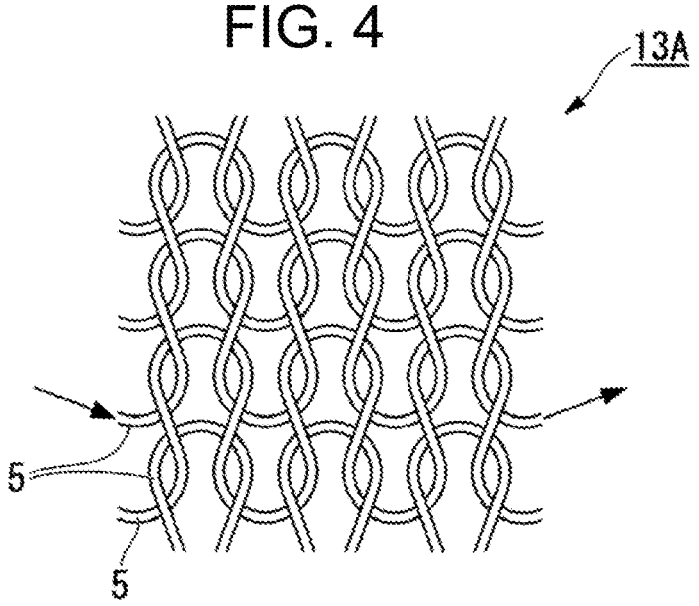
FIG. 4 is a first explanatory view of a mesh of the sound deadening element.

It is to be noted that the sound deadening element 13 may be knitted by plain knitting as depicted in FIG. 4. In this case, starting stitches are created first using a long-fiber yarn 5, and then knitting of face stitches is performed for the first course, whereafter knitting of back switches is performed for the second course. Then, knitting of face stitches is performed for the third course and knitting of back switches is performed for the fourth course, and thereafter, a similar process is repeated.

Figure 5:
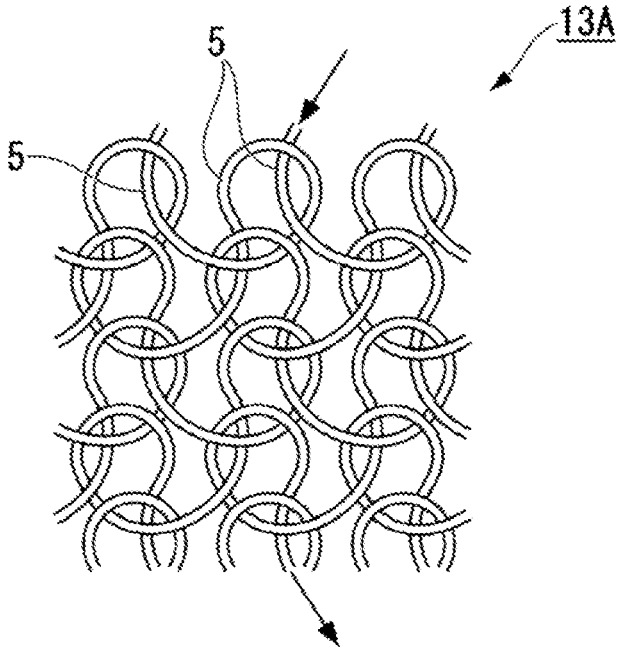
FIG. 5 is a second explanatory view of a mesh of the sound deadening element.

Alternatively, the sound-deadening element 13 may be knitted by plain knitting by weft knitting as depicted in FIG. 5. In this case, long-fiber yarns 5 are successively knitted similarly as in plain knitting described above.

As described above, with the exhaust muffler 10 and the sound deadening element 13 according to the embodiment described above, the sound deadening element 13 inserted in the expansion chamber 11 of the exhaust muffler 10 is configured from the knitted article 13A formed by knitting the long-fiber yarns 5 of glass fiber, exposure of fiber ends of the sound deadening element 13 can be minimized, and the anti-scattering property of the sound deadening element 13 can be improved thereby. Further, since the sound deadening element 13 is configured from the knitted article 13A of the long-fiber yarns 5, the necessity for shaping, which is required when short fibers are used, can be eliminated, and consequently, reduction of the number of fabrication steps can be anticipated.

Further, since the sound deadening element 13 is disposed between the outer circumferential wall 23 of the inner pipe 17 and the inner circumferential wall 26 of the expansion chamber 11, the sound deadening element 13 can be retained by the outer circumferential wall 23 of the inner pipe 17 and the inner circumferential wall 26 of the expansion chamber 11 and can maintain the shape of the sound deadening element 13 readily.

Further, since the sound deadening element 13 is formed in a cylindrical shape continuous in the circumferential direction of the inner pipe 17, it is easy for the sound deadening element 13 to be disposed uniformly in the circumferential direction of the inner pipe 17 and the sound deadening element 13 can be disposed efficiently in the expansion chamber 11 to achieve reduction in weight. Further, since the sound deadening element 13 is configured from the knitted article 13A, the sound deadening element 13 of a cylindrical shape continuous in the circumferential direction can be formed readily.

Further, since the sound deadening element 13 includes the folded portion 27 at which the knitted article 13A is folded back in the axial direction of the inner pipe 17 and the folded portion 27 is disposed on the exhaust upstream side of the expansion chamber 11, the sound deadening element 13 having a plurality of layers can be disposed on the outer circumference of the inner pipe 17 by the folding back of the knitted article 13A. Further, since the folded portion of the knitted article 13A is disposed on the exhaust upstream side, the anti-scattering property on the exhaust upstream side on which the exhaust pressure is high can be improved further in comparison with an alternative case in which the extremity of the knitted article 13A is disposed on the exhaust upstream side.

Further, since the extremity (first extremity t1) of the knitted article 13A of the sound deadening element 13 is disposed on the inner side of the folded portion 27 on the exhaust upstream side of the expansion chamber 11, also where the extremity of the knitted article 13A is disposed on the exhaust upstream side by the folding back of the knitted article 13A, the extremity can be disposed on the inner side of the folded portion thereby to improve the anti-scattering property. Further, by the folding back of the knitted article 13A, the sound deadening element 13 of a multilayer configuration can be disposed on the outer circumference of the inner pipe 17.

Further, since the knitted article 13A is formed from a rib knit article that is elastic, namely, can be expanded and contract, in the circumferential direction of the inner pipe 17 and is folded back in the axial direction and the cotton pad 32 is disposed on the inner side of the folded location of the knitted article 13A, the sound deadening element 13 can be disposed in a fitted state on the outer circumference of the inner pipe 17 by the rib-knit knitted article 13A which is elastic in the circumferential direction of the inner pipe 17. Further, since the cotton pad 32 is disposed on the inner side of the folded knitted article 13A, the sound deadening property can be improved while the anti-scattering property is improved.

Further, in the structure that the through-holes 24 are formed in the outer circumferential wall 23 of the inner pipe 17 such that exhaust gas introduced by the inner pipe 17 passes through the through-holes 24 and is expanded in the expansion chamber 11 and the sound deadening element 13 is retained on the outer circumference of the inner pipe 17 such that exhaust gas having a high exhaust pressure passes through the through-holes 24 of the inner pipe 17 and is expanded in the expansion chamber 11, the sound deadening element 13 is retained on the outer circumference of the inner pipe 17 thereby to eliminate the necessity for a retaining member for exclusive use to achieve simplification and reduction in weight. Further, the energy of the exhaust gas upon expansion can be attenuated effectively by the sound deadening element 13. Further, the necessity for a countermeasure for preventing scattering of the sound deadening element 13 such as to mount a mesh member or the like separately on the outer circumference of the inner pipe 17 can be eliminated. Alto in this regard, simplification and reduction in weight of the exhaust muffler 10 can be anticipated.

Figure 6:
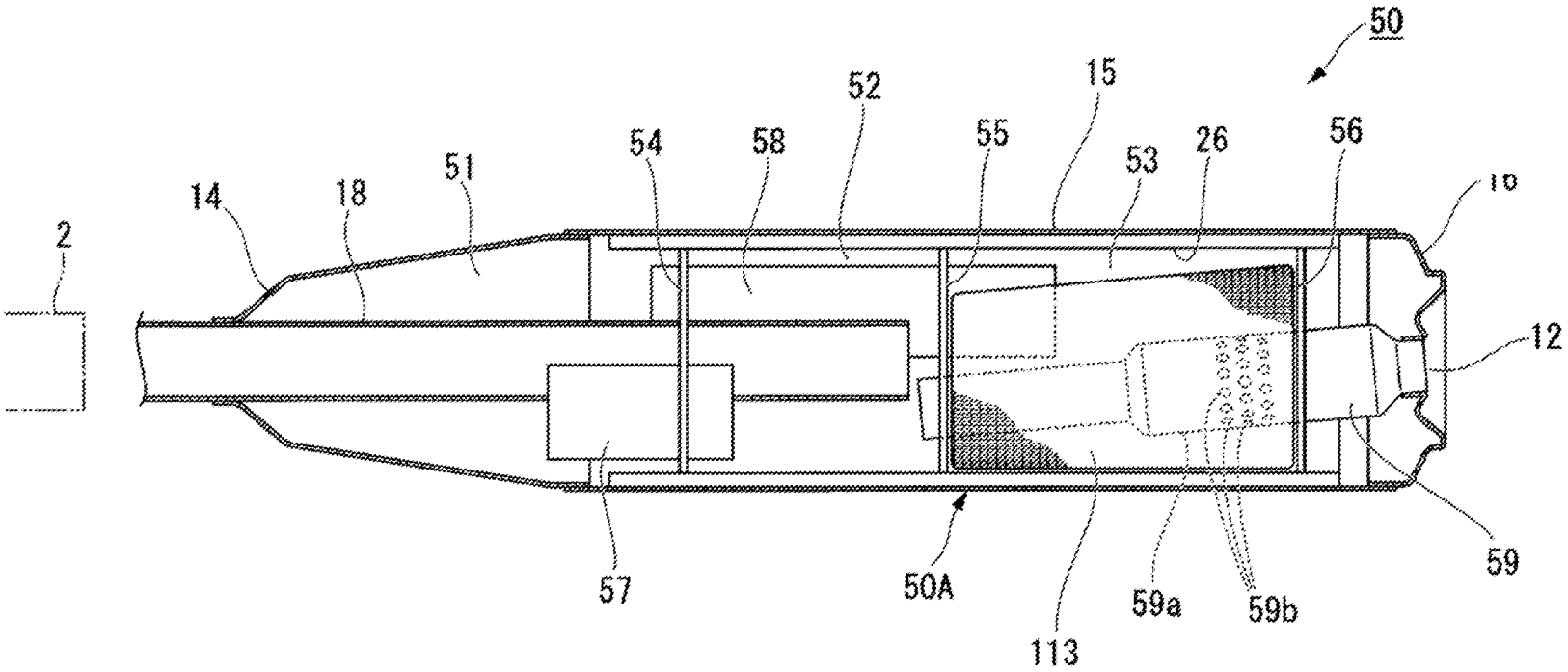
FIG. 6 is a sectional view corresponding to FIG. 1 of an example in which the present invention is applied to a multi-stage expansion type exhaust muffler.

FIG. 6 depicts an example wherein the present invention is applied to an exhaust muffler 50 of the multi-stage expansion type. In FIG. 6, like elements to those of the embodiment described hereinabove are denoted by like reference symbols, and overlapping description of them is omitted herein to avoid redundancy.

A muffler main body 50A of the exhaust muffler 50 has a first expansion chamber 51, a second expansion chamber 52, and a third expansion chamber 53 disposed in order from the front side, which is the exhaust pipe 2 side, toward the rear side.

The first expansion chamber 51 is formed by being surrounded by the front cap 14, a front portion of the inner circumferential wall 26, and a first barrier wall 54. The first barrier wall 54 supports a rear portion of the front pipe 18 and front portions of a first communication pipe 57 and a second communication pipe 58. The first communication pipe 57 communicates the first expansion chamber 51 and the second expansion chamber 52 with each other. The second communication pipe 58 communicates the first expansion chamber 51 and the third expansion chamber 53 with each other.

The second expansion chamber 52 is formed by being surrounded by an intermediate portion in the forward and rearward direction of the inner circumferential wall 26, the first barrier wall 54, and a second barrier wall 55. The second barrier wall 55 supports a rear portion of the second communication pipe 58 and a front portion of a third communication pipe 59. The third communication pipe 59 communicates the second expansion chamber 52 and an external space in the rear of the muffler.

The third expansion chamber 53 is formed by being surrounded by a rear portion of the inner circumferential wall 26, the second barrier wall 55, and a third barrier wall 56. The third barrier wall 56 supports a rear portion of the third communication pipe 59.

A sound deadening element 113 is disposed in the third expansion chamber 53. The sound deadening element 113 is disposed so as to fill up a space between the inner circumferential wall 26 and an outer circumferential wall 59*a* of the third communication pipe 59. The sound deadening element 113 is formed from the knitted article 13A. The sound deadening element 113 is mounted and retained so as to enclose the outer circumference of the third communication pipe 59. In the sound deadening element 113, the knitted article 13A is folded back, for example, similarly to the sound deadening element 13. A plurality of through-holes 59*b* are formed in the outer circumferential wall 59*a* of the third communication pipe 59 such that they can discharge exhaust gas therethrough. Consequently, the energy of exhaust gas upon expansion is attenuated by the sound deadening element 113. It is to be noted that, in the first expansion chamber 51 and the second expansion chamber 52, the sound deadening element may be attached to the other communication pipe (inner pipe).

Also with the exhaust muffler 50 and the sound deadening element 113 described above, similar working effects to those achieved by the embodiment described hereinabove can be anticipated.

It is to be noted that the configuration of the embodiment described hereinabove is an example of the present invention and can be modified in various manners without departing from the spirit and scope of the present invention in regard to the configuration of the exhaust muffler and the knitting manner and so forth of the knitted article.

DESCRIPTION OF REFERENCE SYMBOLS

5 Long-fiber yarn (continuous fiber)
10 and 50 Exhaust muffler
11 Expansion chamber (exhaust gas introduction chamber)
13 and 113 Sound deadening element
13A Knitted article
17 Inner pipe
23 and 59*a* Outer circumferential wall
24 and 59*b* Through-hole
26 Inner circumferential wall
27 First folded portion (folded portion)
32 Cotton pad
51 First expansion chamber (exhaust gas introduction chamber)
52 Second expansion chamber (exhaust gas introduction chamber)
53 Third expansion chamber (exhaust gas introduction chamber)
57 First communication pipe (inner pipe)
58 Second communication pipe (inner pipe)
59 Third communication pipe (inner pipe)
t1 First extremity (extremity)

What is claimed is:

1. An exhaust muffler comprising:

an exhaust gas introduction chamber into which exhaust gas of an engine is introduced and having an exhaust upstream side and an exhaust downstream side;

an inner pipe inserted in a spaced relationship from an inner circumferential wall of the exhaust gas introduction chamber in the exhaust gas introduction chamber and configured to introduce the exhaust gas therethrough; and a sound deadening element inserted in the exhaust gas introduction chamber, wherein the sound deadening element is disposed between an outer circumferential wall of the inner pipe and the inner circumferential wall of the exhaust gas introduction chamber, wherein the sound deadening element includes a first folded portion disposed on the exhaust upstream side and a second folded portion disposed on the exhaust downstream side, each of the first and second folded portions is folded back in an axial direction of the inner pipe such that the sound deadening element has an outer cylindrical portion extending rearward directly from the first folded portion, an intermediate cylindrical portion extending forwardly directly from the second folded portion at a rear end of the outer cylindrical portion, and an inner cylindrical portion extending rearward directly from the first folded portion, and wherein the sound deadening element is configured from a knitted article formed by knitting continuous fibers of glass fiber.

2. The exhaust muffler according to claim 1, wherein the sound deadening element is formed in a cylindrical shape continuous in a circumferential direction of the inner pipe.

3. The exhaust muffler according to claim 1, wherein the intermediate cylindrical portion of the sound deadening element has a free end disposed on an inner side of the first folded portion, and the inner cylindrical portion of the sound deadening element has a free end disposed on an inner circumference side of the second folded portion.

4. The exhaust muffler according to claim 1, wherein the knitted article is formed by a rib knit article which is elastic in the circumferential direction of the inner pipe and is folded back in the axial direction, and a cotton pad separate from the sound deadening element is disposed on an inner side of the first folded portion of the knitted article sandwiched between the intermediate cylindrical portion and the outer cylindrical portion.

5. The exhaust muffler according to claim 1, wherein a through-hole is formed in the outer circumferential wall of the inner pipe, and the exhaust gas introduced by the inner pipe passes through the through-hole and is expanded in the exhaust gas introduction chamber, the sound deadening element being retained on the outer circumference of the inner pipe.

6. The exhaust muffler according to claim 2, wherein the knitted article is formed by a rib knit article which is elastic in the circumferential direction of the inner pipe and is folded back in the axial direction, and a cotton pad is disposed on an inner side of the first folded portion of the knitted article.

7. The exhaust muffler according to claim 3, wherein the knitted article is formed by a rib knit article which is elastic in the circumferential direction of the inner pipe and is folded back in the axial direction, and a cotton pad is disposed on an inner side of the first folded portion of the knitted article.

8. The exhaust muffler according to claim 2, wherein a through-hole is formed in the outer circumferential wall of the inner pipe, and the exhaust gas introduced by the inner pipe passes through the through-hole and is expanded in the exhaust gas introduction chamber, the sound deadening element being retained on the outer circumference of the inner pipe.

9. The exhaust muffler according to claim 3, wherein a through-hole is formed in the outer circumferential wall of the inner pipe, and the exhaust gas introduced by the inner pipe passes through the through-hole and is expanded in the exhaust gas introduction chamber, the sound deadening element being retained on the outer circumference of the inner pipe.

10. The exhaust muffler according to claim 4, wherein a through-hole is formed in the outer circumferential wall of the inner pipe, and the exhaust gas introduced by the inner pipe passes through the through-hole and is expanded in the exhaust gas introduction chamber, the sound deadening element being retained on the outer circumference of the inner pipe.

11. A sound deadening element for being inserted in an exhaust gas introduction chamber of an exhaust muffler, wherein the sound deadening element is formed from a knitted article formed by knitting continuous fibers of glass fiber, wherein the sound deadening element includes a first folded portion disposed on an upstream side and a second folded portion disposed on a downstream side, each of the first and second folded portions is folded back in an axial direction of the sound deadening element such that the sound deadening element has an outer cylindrical portion extending rearward directly from the first folded portion, an intermediate cylindrical portion extending forwardly directly from the second folded portion at a rear end of the outer cylindrical portion, and an inner cylindrical portion extending rearward directly from the first folded portion, wherein the intermediate cylindrical portion has a free end disposed on an inner side of the first folded portion, and the inner cylindrical portion has a free end disposed on an inner circumference side of the second folded portion.

* * * * *